United States Patent [19]

Scorteanu

[11] 4,265,419

[45] May 5, 1981

[54] APPARATUS FOR CAR COUNTING AND DISCRIMINATION

[75] Inventor: Ionel R. Scorteanu, Bucharest, Romania

[73] Assignee: Institutul De Cercetart Si Proiectari Tehnologice In Transporturi, Bucharest, Romania

[21] Appl. No.: 27,048

[22] Filed: Apr. 4, 1979

[30] Foreign Application Priority Data

May 10, 1978 [RO] Romania ..... 93970

[51] Int. Cl.[3] ..... G61L 25/02

[52] U.S. Cl. ..... 246/247; 235/92 TC

[58] Field of Search ..... 246/247, 249, 77, 169 A, 246/169 D, 169 R; 235/92 TC, 92 PK

[56] References Cited

U.S. PATENT DOCUMENTS

| | | | |
|---|---|---|---|
| 3,486,008 | 12/1969 | Mori | 246/247 |
| 3,500,039 | 3/1970 | Kortyna | 246/247 |
| 3,646,327 | 2/1972 | Tonies et al. | 235/92 TC |

FOREIGN PATENT DOCUMENTS

| | | | |
|---|---|---|---|
| 216781 | 4/1968 | U.S.S.R. | 246/247 |

*Primary Examiner*—J. D. Miller
*Assistant Examiner*—Reinhard J. Eisenzopf

[57] ABSTRACT

An apparatus for railway car counting and discrimination comprises three transducers placed at the railway track at given distances from each other and a digital logic circuit for processing the signals from the transducers to obtain a signal for each car passing the transducers.

8 Claims, 14 Drawing Figures

APPARATUS FOR CAR COUNTING AND DISCRIMINATION

BACKGROUND OF THE INVENTION

The present invention relates to an electronic apparatus for counting railway axles and cars irrespective of their type, speed or running direction.

Car counters are known which are of an electromechanical construction and which are used in marshalling yards for transducers, these counters use two electromagnetic treadles placed at a certain distance. The drawback of this type of counters is that as it offers no opportunity for discrimination, since it can be used for counting only one car type.

A car counting discriminator is disclosed in Romanian patent 58714, that makes use of two treadles that control a logical network built of relays. Although this type of counter permits the counting of several car types, it still has certain drawbacks such as: it has a low reliability; it operates only for cars traveling at up to a 30 km/h speed; for cars discrimination it necessitates that the axles should be symmetrically placed as against the transverse median; it cannot discriminate cars whose distance between the bogies axles is greater than 2200 mm; and it cannot dscriminate cars with more than 8 axles.

The detecting system disclosed in U.S. Pat. No. 1,339,971 stipulates conditions for discriminating only cars with four or six axles. The system consists of two treadles and it can be enlarged to four treadles as well.

The system does not specify the distance between treadles and does not refer to cars with two axles or with more than six axles, and the electronic circuitry used is very complex. The fact that the distance betwen treadles is not specified makes the discrimination of many car types debatable.

Another system for detecting a vehicle presence, is disclosed in U.S. Pat. No. 3,500,039. The vehicle detection is made by comparing the states of two counters that can detect the passage of a bogie, which can have at most three axles. This procedure implies the existence of symmetry of the front-back axles number. The system does not specify the distance between treadles, and this makes the discrimination of some car types debatable. This system also does not discriminate cars having more than three axles on a bogie or vehicles whose number of front-back axles is not equal, and moreover the circuitry used is very complex.

There is also known the method and the apparatus described in U.S. Pat. No. 3,646,327. The circuit thereof uses four electronic treadles placed in the track at determined distances. The circuit operation is described for the discrimination of standard American vehicles with 4, 6 and 8 axles. The apparatus does hot detect two axle cars; cars with more than four axles per bogie, or cars that do not have the same number of front-back axles. Additionally, the circuitry is complex and uses a great number of treadles.

Another known method and apparatus is disclosed in U.S. Pat. No. 3,745,335. The system uses for discrimination, two treadles placed at minimum 3850 mm and at maximum 3352 mm one against the other. Each treadle operates a counter and the counters are subject to reset conditions after the passage of each vehicle. The counter states are reciprocally compared as against certain unique states. This system applies to the discrimination of standard American railway vehicles with 4, 6 and 8 axles only. The system does not refer to two axles cars. It often happens that the distance between the axles of two coupled cars should be smaller than 3150 mm. These car types will not be discriminated. The system does not refer to cars having more than 4 axles per bogie and cannot detect cars having unequal number of front-back axles.

SUMMARY OF THE INVENTION

The object of the invention is to provide an apparatus for car counting and discrimination which eliminates the drawback of the above-mentioned patents, by the fact that for discriminating cars with bogies having the distance between axles smaller than 2600 mm and cars with bogies having the distance between axles greater than 2600 mm, it uses three electronic treadles, two of which are placed on one of the rails at 2600 mm from each other and the third treadle being placed on the other rail at a 3700 mm from the remotest treadle. The electronic signals generated by the electronic treadles placed at a 2600 mm distance on the one hand, and the electric signals generated by the electric treadles at a 3700 mm distance on the other hand, are applied at the inputs of two identical electronic logic networks, at whose outputs a pulse for each bogie is obtained. The two logic networks are each made up of a binary up/-down counter, having the initial state 1111; the signals from the treadles control the counter to count up and to count down; any modification of the counter from the initial position is sensed by a NAND circuit, whose output represents the bogie signal. The bogie signal obtained by the logical processing of the pulses given by the treadles placed at a 2600 mm distance passes through a flip-flop and is introduced in an AND circuit, together with the bogie signal obtained by the logical processing of signals from the treadles placed at a 3700 mm distance. The output of AND circuit controls, by means of an OR circuit, the final flip-flop that recognizes the cars. If in the 2600 mm there are, at a certain moment, two axles, this is sensed by detecting with two AND circuits that control an OR circuit, the counting positions 1101 and 0001 of one up/down counter, then the final flip-flop is directly controlled by the bogie signal generated by the logical processing of the pulses obtained from the treadles placed at a 2600 mm distance. The logic is repeated from zero for each car passage.

According to the invention, the installation for car counting and discrimination has the following advantages:

it can be constructed according to two embodiments with two electronic treadles, whereby it can discriminate any freight car type;

it can be constructed according to a third embodiment with three electronic treadles, whereby it can also discriminate passengers coaches with bogies whose wheel base is of 3000 mm or 3600 mm;

it can also discriminate railway vehicles with a different number of front-back axles;

it can count and discriminate cars irrespective of the running direction and speed; and it has a high reliability, due to the use of integrated circuits.

Numerous other features, objects and advantages of the invention will become apparent from the following specification when read in conjunction with the accompanying drawings wherein:

DETAILED DESCRIPTION OF THE PREFERRED EMBODIMENTS

Figures 1A, 1B, 1C, 1D, 1E, 1F:
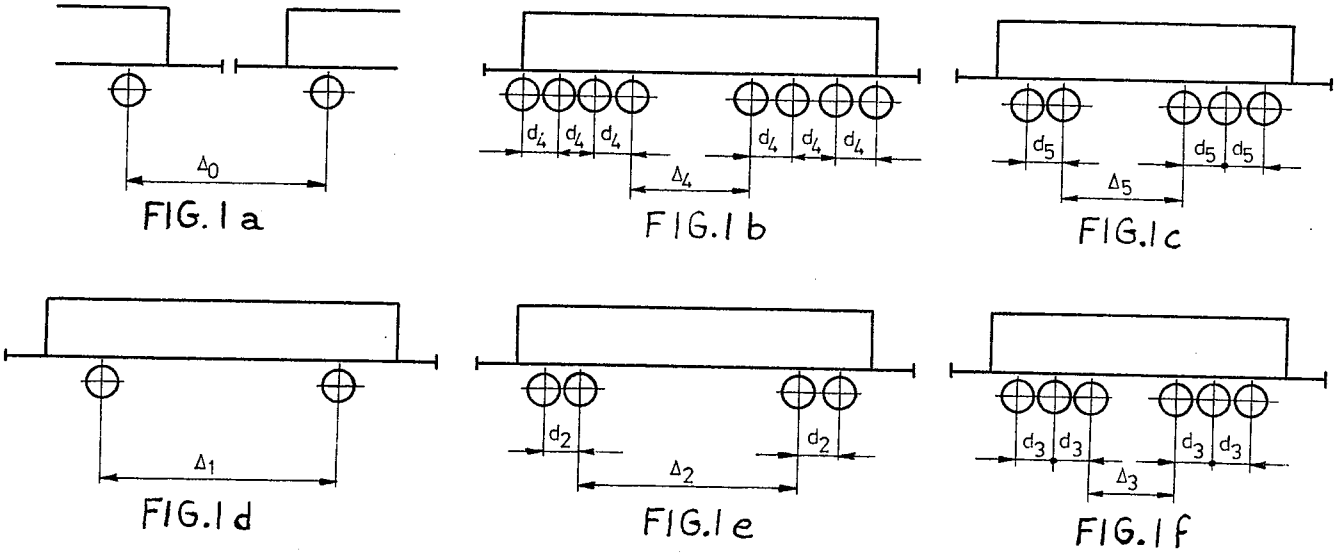
FIGS. 1*a*-1*f* are diagrams showing the characteristic dimensions for different cars and locomotives.

The problem of car counting or discriminating involves a certain difficulty, resulting from the large number of existent freight car types. Referring to FIGS. 1*a*–1*f*, there are cars with two axles (without bogies) as shown in FIGS. 1*a* and 1*d*, cars with four (FIG. 1*e'*), *six (FIG. 1f)*, eight (FIG. 1*b*), ten, and twenty axles distributed on two bogies, as well as cars with an odd number of axles also distributed on two bogies, as shown in FIG. 1*c*. In FIG. 1*a* the distance between the outer axles of two coupled cars has been labeled $\Delta_0$ and in FIGS. 1*b*–1*f*, the distance between the inner axles for different car types has been labeled $\Delta_1, \Delta_2, \ldots \Delta_5$, and the distance between the axles of a bogie for the respective car types has been labeled $d_2 \ldots d_5$.

Figure 2:
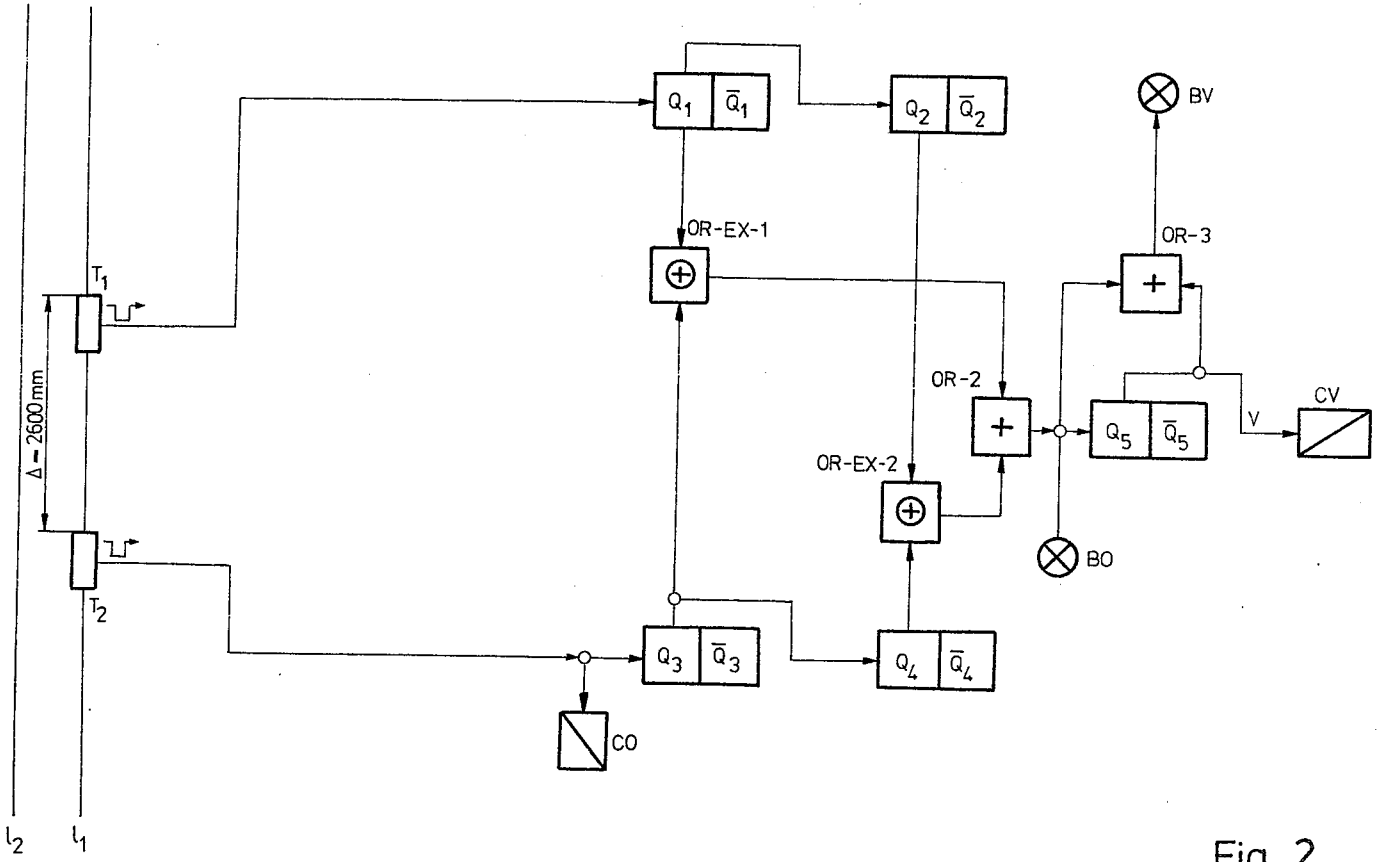
FIG. 2 is a block diagram of a first embodiment of a logic network discriminating bogie cars having a maximum wheel base of 2500 mm.
Figure 3:
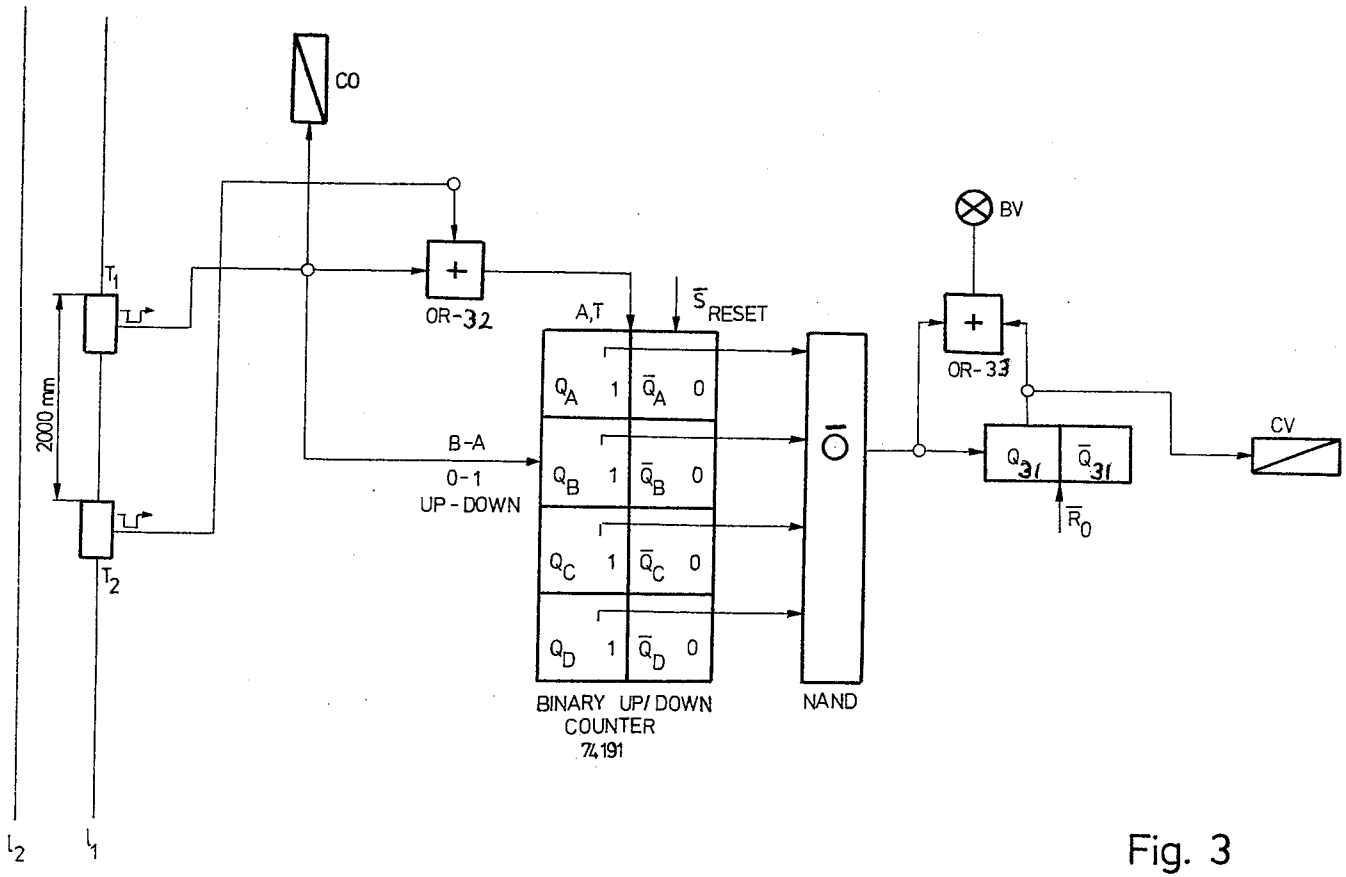
FIG. 3 is a block diagram of a second embodiment of a logic network for discriminating bogie cars having a maximum wheel base of 2500 mm.

According to the present invention, in order to detect the presence of a running or resting car, three electronic treadles $T_1$, $T_2$, $T_3$, are used. Two of these, $T_1$ and $T_2$ are placed on one rail $l_1$ at a 2600 mm distance from each other, as shown in FIGS. 2–4, and the third $T_3$ is placed on the other rail $l_2$ at a 3700 mm distance from the remotest treadle $T_1$, as shown in FIG. 4.

These treadles are transducers for sensing the axle presence and are basically known in the art. The treadler must generate an axle presence signal, irrespective of the running speed of the car. With a view to operating at zero axle speed as well, the treadle generally uses the effect of modifying the direction of an electromagnetical field in the presence of a metallic body. An example of this type of treadle which will operate with the circuitry of the present invention is the AzS 70, manufactured by the Siemens Company.

For the discrimination of all cars on two axles, of all cars with three or more axles per bogie and of the cars on bogies of two axles having the maximum distance between the bogies axles of 2500 mm, in accordance with the circuitry of the present invention only two electronic treadles located at a 2600 mm distance from each other need be used. Two embodiments of circuitry for processing the signals are shown in the block diagram of FIG. 2 and the block diagram of FIG. 3. In fact, all freight car types can be discriminated by means of these two embodiments.

Figure 4:
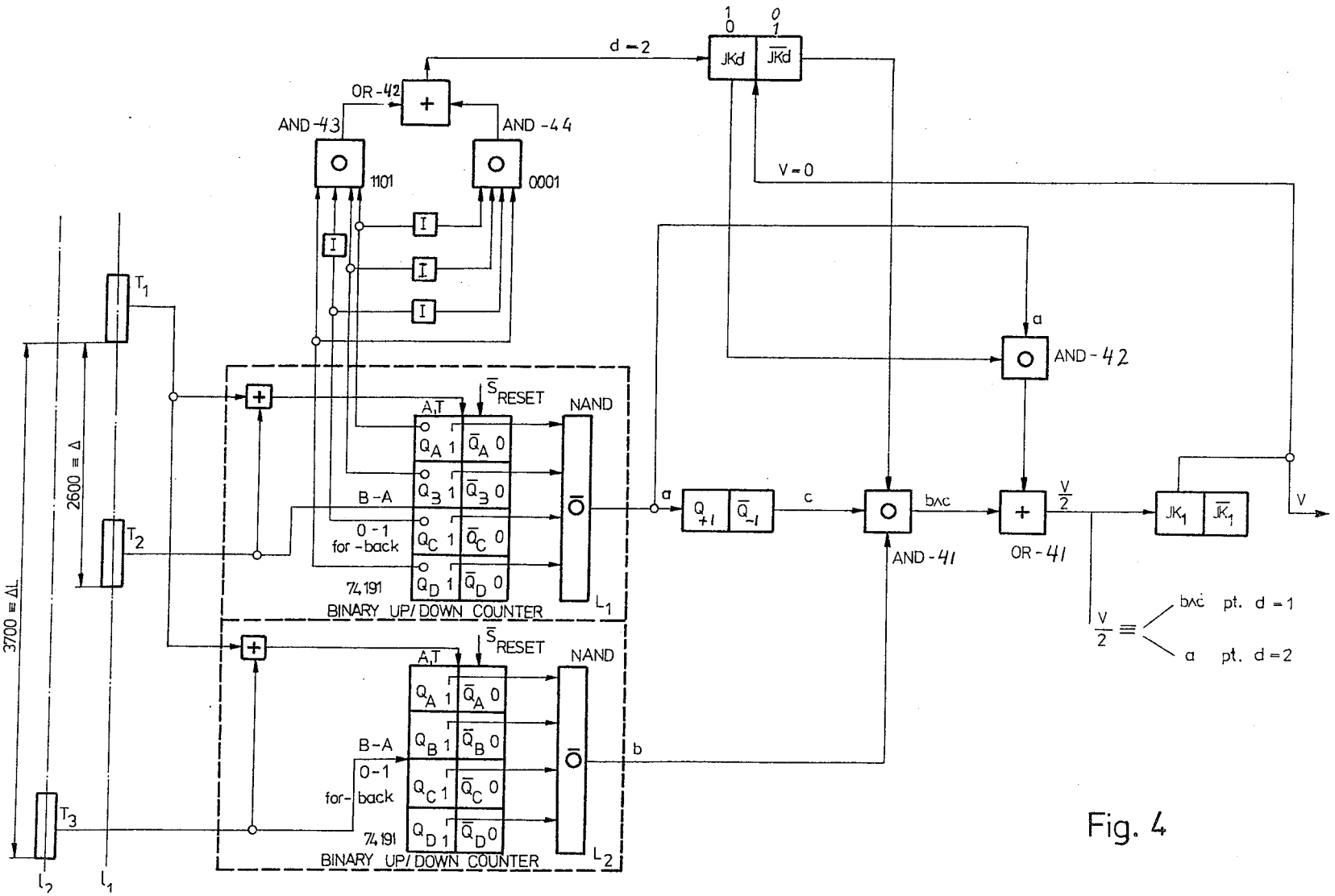
FIG. 4 is a block diagram of a third embodiment of a logic network for car discrimination.
Figure 5:
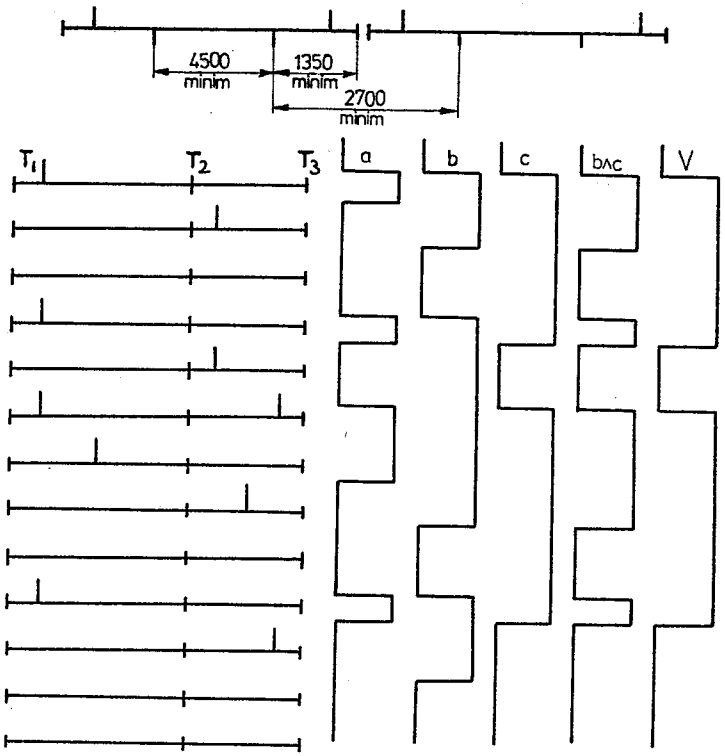
FIG. 5 is a diagram of signals generated by the network of FIG. 4 for the case of two coupled cars, on two axles.
Figure 6:
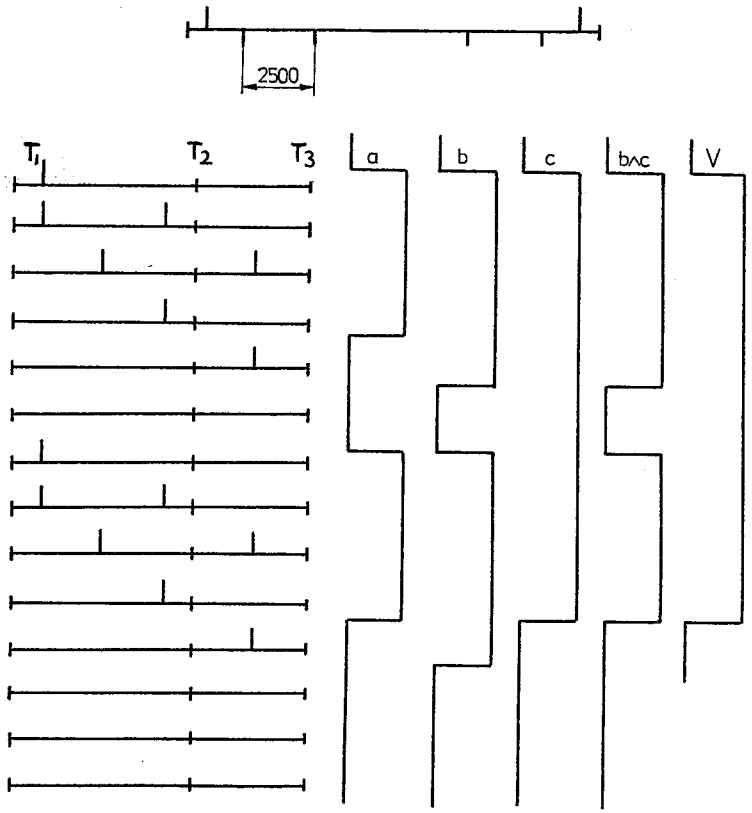
FIG. 6 is a diagram of signals generated by the network of FIG. 4 for the case of a car on bogies having the distance between axles of 2500 mm.
Figure 7:
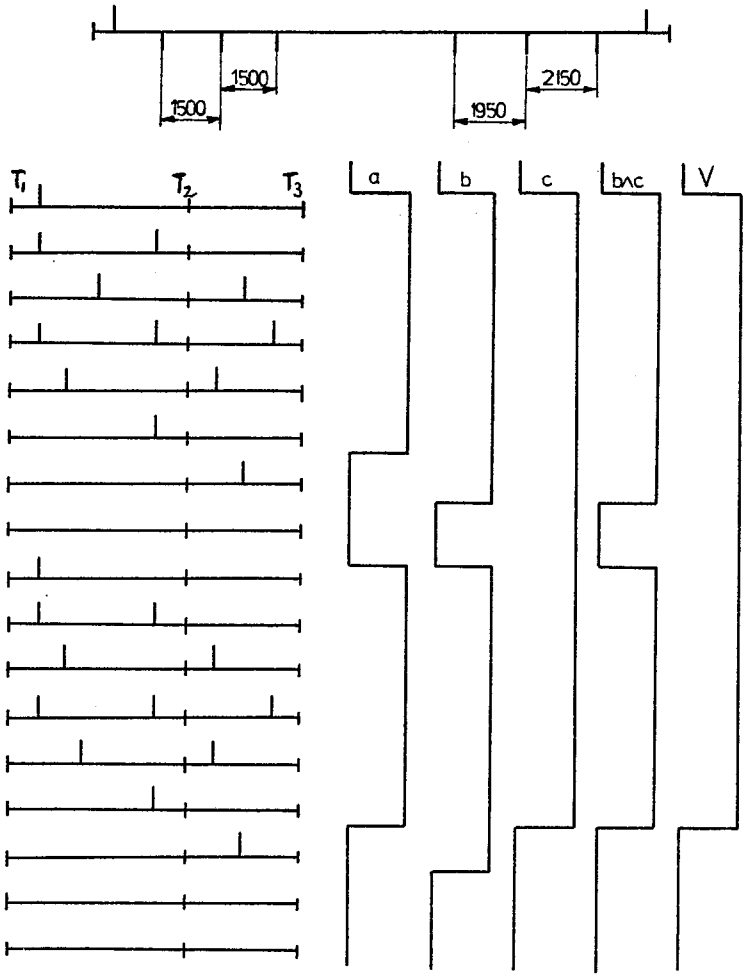
FIG. 7 is a diagram of signals produced by the network of FIG. 4 for the case of a car with two axle bogies; the second bogie being a bogie of a Diesel locomotive.
Figure 8:
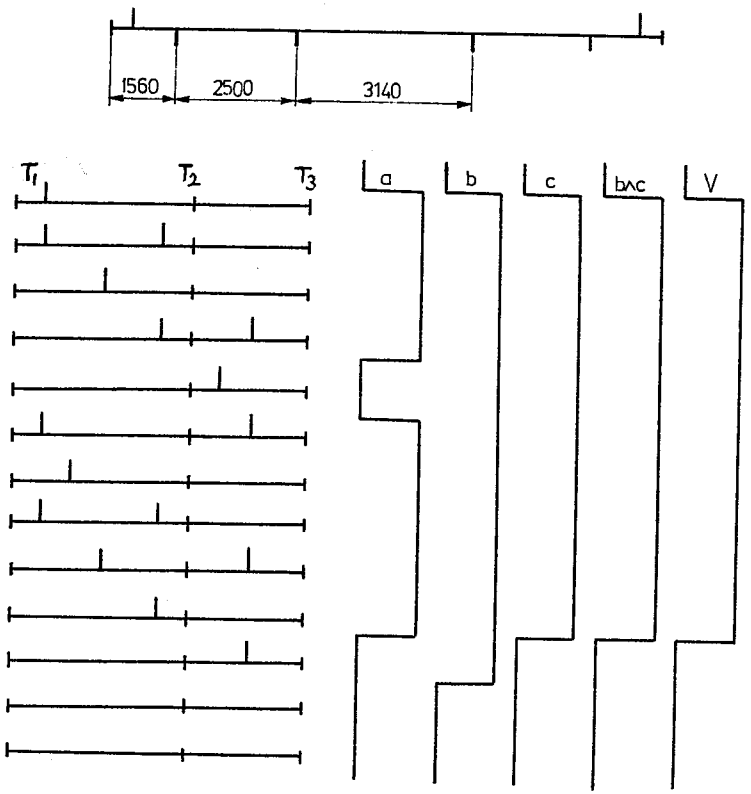
FIG. 8 is a diagram of signals produced by the network of FIG. 4 for the case of a Diesel hydraulical locomotive LDH-70.
Figure 9:
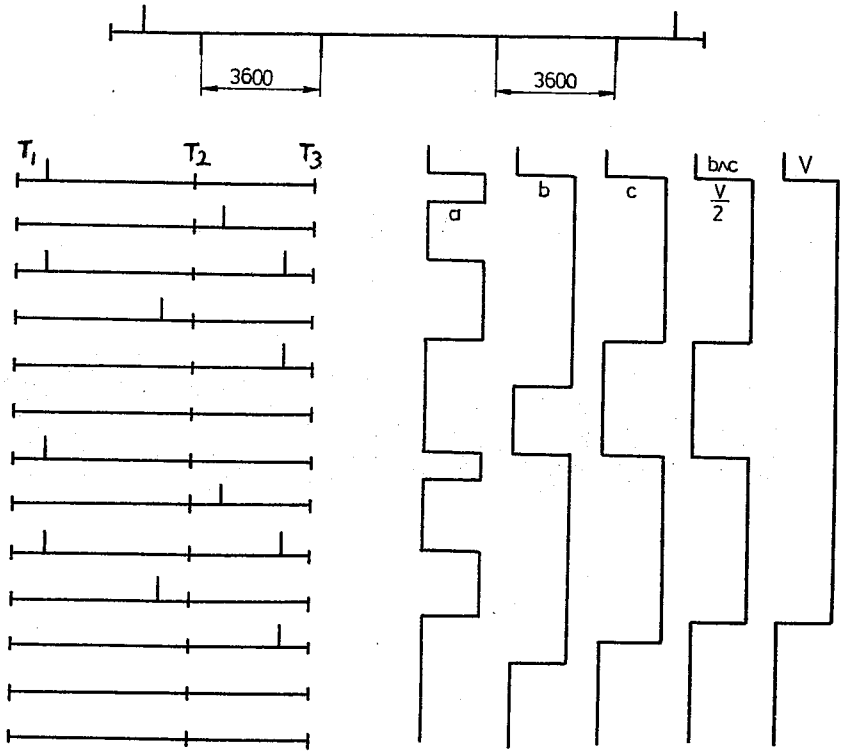
FIG. 9 is a diagram of signals produced by the network of FIG. 4 for the case of a car on bogies having the distance between axles of 3000–3600 mm.

The three treadle circuit shown in FIG. 4 is used for the discrimination of all freight cars and passenger coaches having bogies on two axles, having the wheel base of 2500 mm, such as the heavy Goerlitz type bogies, having the wheel base of 3000 mm or 3600 mm.

Referring now to FIG. 2, the circuit of the present invention includes two sets of two series connected flip-flop $Q_1$, $Q_2$ and $Q_3$, $Q_4$ and two EXCLUSIVE-OR circuits OR-EX-1 and OR-EX-2 which receive the outputs of $Q_1$, $Q_3$ and $Q_2$, $Q_4$, respectively. The outputs of OR-EX-1 and OR-EX-2 are applied to the inputs of OR circuit OR-2 whose output is applied to the input of flip-flop $Q_5$. The output of $Q_5$ is applied to car counter CV as well as to the input of OR-circuit OR-3 along with the output of OR-2.

The output of OR-2 drives the BO indicator light which signals whether there is an axle within the interval $\Delta$, the output of OR-3 drives the indicator light BV which signals that there is a car in the $\Delta$ interval and the output of treadle $T_2$ can be used to drive axle counter CO.

In operation, when a 4-axle car goes over the installation, the first axle will actuate treadle $T_1$, which sets $Q_1$, thereby changing the state of OR-EX-1 to "1", which forces OR-2 to a "1" and sets $Q_5$. Next, before the first axle reaches treadle $T_2$ owing to distance between axles being less than 2600 mm, the second axle will actuate treadle $T_1$ again, setting $Q_2$ and resetting $Q_1$. While OR-EX-1 goes back to "0", OR-EX-2 will go to "1" and thus OR-2 will remain at "1". The first and second axles will then acutate treadle $T_2$ thereby setting $Q_3$ and then $Q_4$ in a manner analogous to $Q_1$ and $Q_2$. When $Q_4$ is set both OR-EX-1 and OR-EX-2 will be at "0" and thus so will OR-2.

The third and fourth axles will thereafter similarly actuate treadles $T_1$ and $T_2$, with the actuation of treadle $T_1$ by the third axle setting OR-2 to "1" with $Q_5$ being reset to "0" and not being set again until the arrival of the next car, thus effecting one count per car.

Since OR-EX-1 and OR-EX-2 are at "1" as long as there is an axle in the $\Delta$ interval, the circuit can also discriminate steam locomotives whose axles have an asymmetrical front-back arrangement and meet the geometrical requirements set for the above.

Referring now to FIG. 3, the outputs of treadles $T_1$ and $T_2$ are applied to the inputs of OR-circuit OR-32, whose output is applied to the clock input AT of a binary up-down counter such as the 74191 by Signetics. The output of treadle $T_1$ is also applied to the up-down input B-A of the counter whose flip-flop $Q_A$, $Q_B$, $Q_C$ and $Q_D$ are preset to the 1111 state, so that treadle $T_1$ counts the counter up while $T_2$ counts the counter down. A NAND-circuit recieves the outputs of $Q_A$–$Q_D$ and thus senses any change in the counter from the initial preset state and has the output thereof connected to the input of flip-flop $Q_{31}$ and to one input of OR-circuit OR-33, whose other input is the output of $Q_{31}$.

As in the circuit of FIG. 2, the same functions are performed by CO, BV and CV.

In operation, if a 4-axle car goes over the installation, the first axle will actuate treadle $T_1$, which will effect a count of 1110 in the counter. This will force the NAND circuit to "1" and thereby set $Q_{31}$. The actuating of $T_1$ will then next be effected by the second axle, since the distance between axles is less than 2600 mm (Δ) and the count will be changed to 1101. This will not change the state of the NAND circuit or $Q_{31}$.

The first and second axles will then actuate treadle $T_2$ which will then make the counter count up again to the states of 1110 and 1111, respectively. Upon reaching the 1111 state, the NAND circuit will be forced to "0". Since $Q_{31}$ will still be at "1" the output of OR-33 will still be at "1" so that BV will indicate the continued presence of a car in the interval Δ.

The third and fourth axles will similarly actuate treadles $T_1$ and $T_2$ to control the counter, however, upon the actuation of $T_1$ by the third axle, $Q_{31}$ will be reset until the next car arrives. Thus counter CV gets a single count pulse per car. However, the output of OR-32 will remain at "1" until the fourth axle actuate $T_2$, thus BV will indicate the presence of a car in the interval Δ.

If the car is running in the reverse direction, treadle $T_2$ will be the first one actuated and the counter will then count to the 0000 and 0001 states respectively, before being counted down to 0000 and 1111 by the respective actuation of $T_1$ by the axles.

The logic operation of the circuitry is similar for vehicles having more than two axles per bogie or having different numbers of axles on the two bogies.

Also, as shown, the counter and $Q_{31}$ may be externally preset and reset respectively upon system start in order to put the circuit in the proper initial state.

Referring now to FIG. 4, a circuit is shown for the discrimination of all types of freight cars, as well as passenger coaches having bogies having a wheel base greater than 2600 mm. The circuit utilizes the three treadle $T_1$, $T_2$ and $T_3$ as well as two identical logic networks $L_1$ and $L_2$ which are the same in function and in operation as that described in FIG. 3.

In order to process the signals generated from the $T_1$-$T_2$ and $T_1$-$T_3$ logic networks, flip-flop $Q_{41}$ has the input thereof connected to the output (a) of the NAND-circuit for the $T_1$-$T_2$ logic network, while the output of the NAND-circuit (b) of the $T_1$-$T_3$ logic network is applied to one input of AND-circuit AND-41 which receives another input from the output (c) of $Q_{41}$. AND-circuit 42 which receives one input from the output of the $T_1$-$T_2$ logic network and the outputs of AND-41 and AND-42 are applied to the inputs OR-circuit OR-41 which has its output connected to the input of final flip-flop $JK_1$ whose output (v) represents the car counter.

The remaining circuitry controls whether the signal (a) or the signal ($b \cap c$) will be applied through OR-41 to the final flip-flop $JK_1$. This remaining circuitry determines the presence of two axles within the interval between treadles $T_1$ and $T_2$ and comprises AND circuits AND-43 and AND-44, which are connected to the outputs $Q_A$-$Q_D$ of the corresponding counter and by means of the inverters I disposed in series therewith produce a logic "I" signal when the counts 1101 and 0001 are respectively reached. The outputs of AND-43 and AND-44 are applied to the inputs of OR-circuit OR-42 whose output is applied to the input of flip-flop $JK_d$. The output $JK_d$ is then applied to one input of AND-42, while the output $JK_d$ is applied to one input of AND-41. The output of $JK_1$ is used to reset the state of $JK_d$ and the counters are externally presettable to the initial state upon first turning power on.

In operation, if two axles are not present in the interval Δ, then the outputs of AND-43 and AND-44 and therefore OR-42 are "0" with $JK_d=0$. Thus, AND-41 is enabled and AND-42 is disabled and signal $b \cap c$ is being applied to the final flip-flop. When either the count 1101 or 0001 is reacted in the counter of the $T_1$-$T_2$ logic network, signifying two axles are in the interval Δ, then the output of OR-42 is "1" and the state of $JK_d$ is changed to "1" enabling AND-42 and disabling AND-41, whereby signal (a) is applied to the input of the final flip-flop.

In accordance with the description of the circuit of FIG. 3 and the fact that $JK_d$ is reset to zero for each car passage, it can be seen that the logic is repeated from its initial state for each car passage.

In order to illustrate the operation of the circuit of FIG. 4, FIGS. 5–9 depict typical axle arrangements for cars, the relative positions of the axles as they pass treadles $T_1$, $T_2$ and $T_3$ and the signal outputs a, b, c, $b \cap c$ and V as the axles actuate the treadles $T_1$, $T_2$ and $T_3$.

While preferred embodiments of the invention have been shown by way of example in the drawings, it will be understood that the invention is in no way limited to these embodiments.

What is claimed is:

1. An apparatus for counting and discriminating railway cars irrespective of their type, speed or running direction comprising:

means for detecting an axle passing thereby along a two rail track comprising three transducers including a pair of transducers at one rail and spaced apart 2600 mm along said one rail and a third transducer disposed at the other rail and spaced apart 3700 mm from the furthest transducer of the pair, said transducers producing an electrical pulse signal in response to the passing thereby of a car axle; and circuit means for processing the signals from the three transducers to effect the counting of railway cars passing thereby during use.

2. An apparatus for counting and discriminating railway cars comprising:

means for detecting an axle passing thereby along a two rail track comprising three transducers including a pair of transducers at one rail and spaced apart 2600 mm along said one rail and a third transducer disposed at the other rail and spaced apart 3700 mm from the furthest transducer of the pair, said transducers producing an electrical pulse signal in response to the passing thereby of a car axle; and circuit means for processing the signals from the three transducers to effect the counting of railway cars passing thereby during use, said circuit means comprising a first digital logic network receptive of the electrical pulse signals from the pair of transducers, a second digital logic network identical to the first digital network and receptive of the electrical pulse signals from the two transducers spaced apart 3700 mm and a third digital logic network receptive of the outputs of the first and second digital logic networks to produce a car counting signal representative of the number of cars passing the detecting means and independent of number of axles or axle separation of each car.

3. The apparatus according to claim 2, wherein the first and second digital logic networks each comprises a four bit up-down counter preset to the 1111 state having the up-down count input connected to one transducer output and the count input connected to a logical OR of the two transducer outputs associated therewith and a four input NAND circuit connected to the counter and producing a logic 0 when the counter is in the preset count.

4. The apparatus according to claim 3, further comprising means for indicating the presence of two axles within the area between the pair of transducers comprising two four input AND-circuits connected to the up-down counter of the first digital logic network, one AND circuit generating a logic 1 output when the count of 1101 is reached and the other AND-circuit generating a logic 1 output when the count of 0001 is reached, and OR-circuit connected to outputs of the AND-circuits and an indicator flip-flop triggered by the output of the OR-circuit.

5. The apparatus according to claim 4, wherein the third digital logic network comprises a final flip-flop, the output of which develops a pulse signal corresponding to each car passing the detecting means, an intermediate flip-flop triggered by the output the first digital logic network, a final AND-circuit receptive of the output of the intermediate flip-flop and the output of the second digital logic network and means for alternately applying the output of the final AND-circuit or the output of the first digital logic network to the final flip-flop depending upon the state of the indicator flip-flop.

6. The apparatus according to claim 5, wherein the output of the final flip-flop is connected to the reset input of the indicator flip-flop to reset same after th passing of each car.

7. An apparatus for counting and discrimination of railway cars having a maximum distance of 2500 mm between bogie axles, comprising:

means for detecting an axle passing along a two rail track comprising two transducers at one rail and spaced apart 2600 mm along said one rail, said transducers producing an electrical pulse signal in response to the passing thereby of a freight car axle; and logic means for processing the signals from the transducers to effect the counting of railway freight cars thereby during use comprising a first pair of flip-flops connected in series and triggered by the signals from one transducer, a second pair of flip-flops connected in series and triggered by the signals from the other transducer, a first EXCLUSIVE-OR circuit receptive of the outputs of the first flip-flops of each pair, a second EXCLUSIVE-OR circuit receptive of the outputs of the second flip-flops of each pair, an OR-circuit receptive of the outputs of the two EXCLUSIVE-OR circuits and a final flip-flop triggered by the output of the OR-circuit for generating an output signal for each car passing the detecting means.

8. An apparatus for counting and discrimination of railway cars having a maximum distance of 2500 mm between bogie axles, comprising:

means for detecting an axle passing thereby along a two rail track comprising two transducers at one rail and spaced apart 2600 mm along said one rail, said transducers producing an electrical pulse signal in response to the passing thereby of a freight car axle; and logic means for processing the signals from the transducers to effect the counting of railway freight cars thereby during use comprising a four bit up-down counter and a count input thereof connected to one transducer and the count input connected to a logical OR of the two transducer outputs and preset to the 1111 state, a four input NAND-circuit connected to the counter and producing a logic 0 output when the counter is in the preset count and a final flip-flop triggered by the output of the OR-circuit and producing an output signal corresponding to each freight car passing the detecting means.

* * * * *